United States Patent [19]

Wright

[11] 4,243,197

[45] Jan. 6, 1981

[54] PAD FOR PROTECTING FLOORS AGAINST WATER DAMAGE

[76] Inventor: Marvin D. Wright, Rte. 2, Box 10, Madisonville, Tenn. 37354

[21] Appl. No.: 51,546

[22] Filed: Jun. 25, 1979

[51] Int. Cl.[3] ..... E04F 15/00; E04B 5/48

[52] U.S. Cl. ..... 248/678; 220/DIG. 6

[58] Field of Search ..... 428/131; 248/346, 678, 248/679; 206/320; 220/1, 3.2, 3.3, 69, DIG. 6; 52/34, 302, 602

[56] References Cited

U.S. PATENT DOCUMENTS

| | | | |
|---|---|---|---|
| 2,783,476 | 3/1957 | Reed | 220/1 X |
| 2,897,974 | 8/1959 | Cook | 248/346 X |
| 3,096,781 | 7/1963 | Roidt | 248/678 X |
| 3,356,209 | 12/1967 | Pezely, Jr. | 206/586 X |
| 3,481,632 | 12/1969 | Suess | 52/302 X |
| 3,701,465 | 10/1972 | Richter | 206/586 X |
| 3,788,581 | 1/1974 | Rutzick | 248/678 |
| 3,790,115 | 2/1974 | Fox et al. | 248/679 |

*Primary Examiner*—Henry F. Epstein

*Attorney, Agent, or Firm*—Diller, Ramik & Wight

[57] ABSTRACT

This disclosure relates to a pad for protecting floors against water damage from washers, dryers or like appliances including a generally polygonally contoured peripheral wall having upper and lower terminal edges, the latter of which are adapted to rest upon a floor and the upper of which defines an interior within which is adapted to be disposed the lower end portion of a washer, dryer or the like, a supporting ledge inboard of the peripheral wall upon which legs of the appliance rest, and a chamber within and slightly beneath the ledge within which any water spilled or leaked from a washer, dryer or like appliance may be collected or drained therefrom.

11 Claims, 6 Drawing Figures

PAD FOR PROTECTING FLOORS AGAINST WATER DAMAGE

Washers, dryers, hot water heaters, dehumidifiers or like appliances may leak or have water drained therefrom in one fashion or another, and if appropriate precautions are not taken such water or moisture can cause damage by, for example, wetting, warping, and/or otherwise deteriorating wood floors, damaging tile, creating mildew, etc. When kitchen appliances (dishwashers, for example) or utility appliances (washers, dryers and like) are properly installed with appropriate connections, leakage generally does not occur but over years of use seals and gaskets wear, connections deteriorate, and leakage becomes increasingly commonplace.

In order to overcome damage created by water leakage from clothes washers, dishwashers, clothes dryers, water heaters or like utility and/or kitchen appliances, the present invention provides a pad for protecting floors upon which such appliances are seated. The pad includes a generally polygonally contoured peripheral wall having an interior within which is disposed a lower end portion of an appliance, a supporting wall or ledge spans the interior of the peripheral wall upon which rests the legs of an associated appliance at each of four corners of the pad, and inboard of the ledge there is provided a chamber for receiving therein any water spilled or leaked from the appliance with a bottom wall of the chamber being selectively apertured or unapertured, and in the latter case, the apertured bottom wall is suitably connected to an appropriate drain.

In further accordance with this invention the pad is formed with a pair of such water-receiving chambers, each having a bottom wall portion with one bottom wall portion being unapertured and the other bottom wall portion being apertured to respectively receive a clothes dryer and a clothes washer in generally side-by-side relationship.

Yet another object of this invention is to provide a novel pad of the type heretofore described wherein each corner of the pad, be it for a single appliance or multiplé appliance, is provided with a reinforcing foot at each corner thereof beneath the supporting ledge for reinforcing each corner against localized load forces imposed thereon through feet of an associated appliance.

Still another object of this invention is to provide a novel pad of the type aforesaid wherein the same is preferably constructed from a single piece of molded, integral, high impact, homogeneous polymeric material or may ultimately be constructed from metal, fiberglass, polyester, or combinations thereof.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
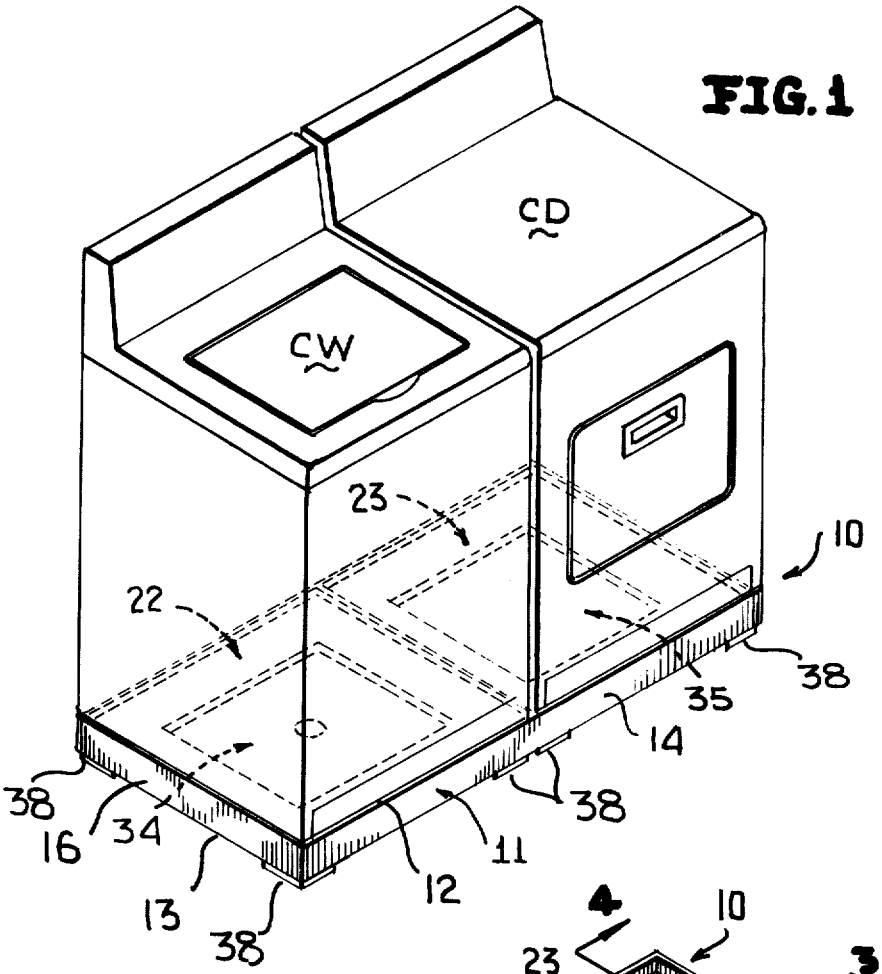
FIG. 1 is a perspective view of a novel pad for protecting floors against water damage, and illustrates a clothes washer and a clothes dryer resting upon and partially within the pad.
Figure 2:
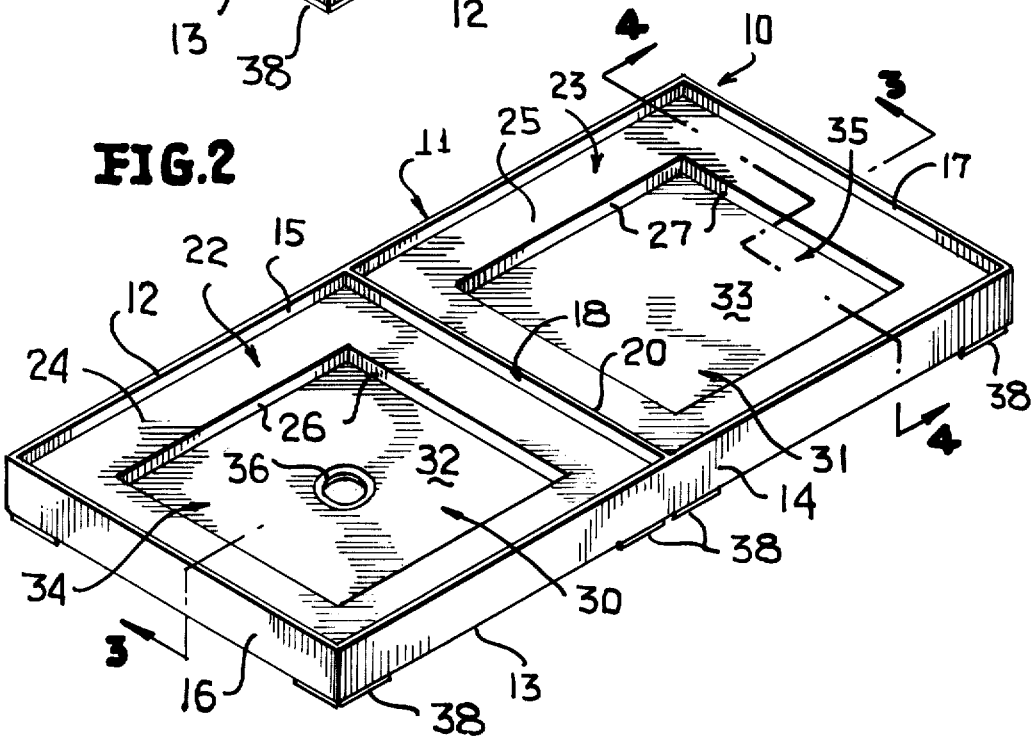
FIG. 2 is a perspective view of the pad of FIG. 1, and illustrates two water-collecting chambers each bounded by a supporting wall or ledge, and a generally polygonally shaped outermost peripheral wall having a plurality of corners at each of which is a reinforcing foot.
Figure 3:
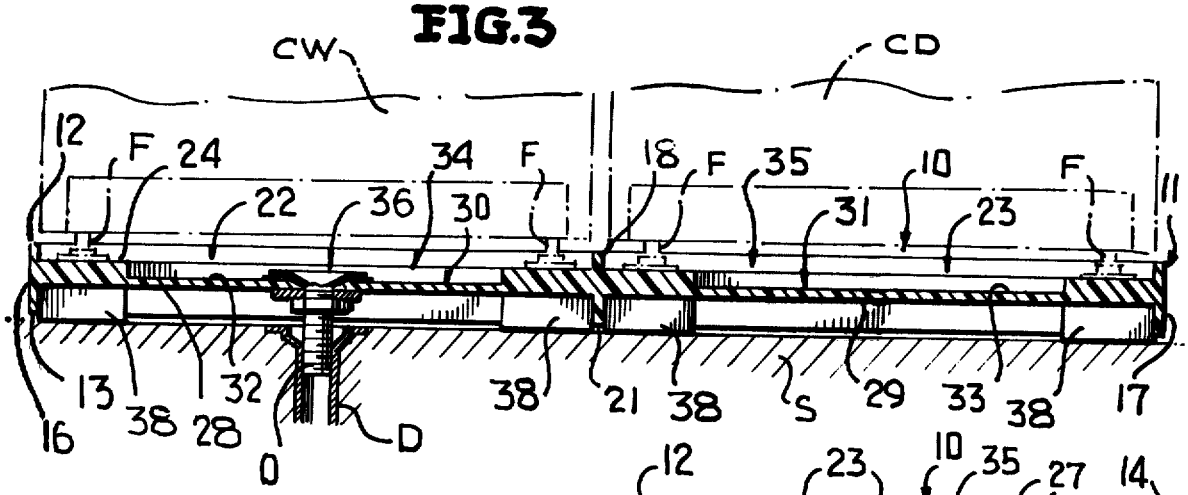
FIG. 3 is a cross-sectional view taken generally along line 3—3 of FIG. 2, and illustrates further details of the pad including apertured and unapertured bottom walls of the associated chambers with the apertured wall having an outlet for connection to a standard household drain.
Figure 4:
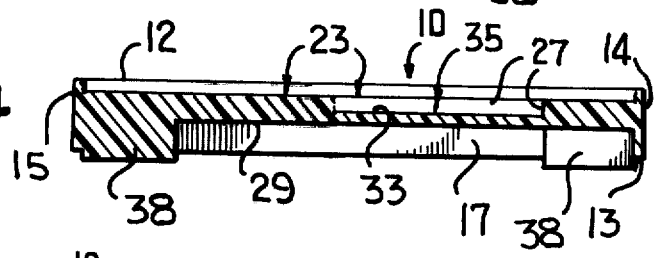
FIG. 4 is a sectional view taken generally along line 4—4 of FIG. 2, and illustrates one of a plurality of integral reinforcing feet formed integrally with and beneath the supporting ledge of the pad.

A novel pad constructed in accordance with this invention is generally designated by the reference numeral 10 (FIGS. 1 through 5) and is adapted to rest upon a conventional supporting surface S (FIG. 3) which may be, for example, a concrete floor, a tile floor, a wooden floor, or the like, and may be provided with a conventional drain D (FIG. 3).

The pad 10 is particularly adapted for protecting the floor or supporting surface S against water damage from, for example, a clothes washer CW (FIG. 1) and a clothes dryer CD, each having a lower end portion (unnumbered) seated upon and partially received within a generally polygonally contoured peripheral wall 11 of the pad 10. The purpose of the pad is to collect water which spills or leaks from the associated clothes washer CW, the clothes dryer CD or similar utility room and/or kitchen appliances as, for example, dishwashers, combination dishwashers and dryers, hot water heaters, dehumidifiers, or the like. Unless such water is prevented from contacting the supporting surface S, the latter will be deteriorated to some extent and even if relatively unaffected by the water, the latter will cause undesired problems as, for example, excess humidity, the creation and propagation of mildew, etc.

The polygonal contour of the peripheral wall 11 is illustrated as being rectangular to accommodate the two appliances CW and CD, but the same may be perfectly square or of another shape depending, of course, upon the particular appliance with which the pad 10 is adapted to be associated. In any event, the peripheral wall includes an upper terminal edge or edge portion 12 and a lower terminal edge or edge portion 13, and for purposes of description the overall peripheral wall 11 may be considered to be composed of a front wall or wall portion 14, a rear or back wall or wall portion 15, an opposite side or end walls or wall portions 16, 17, although the terms "front end," "rear end," "side end" and/or "end" have no significance other than indicating relative location of these walls to each other and the appliances CW, CD associated therewith.

Figure 5:
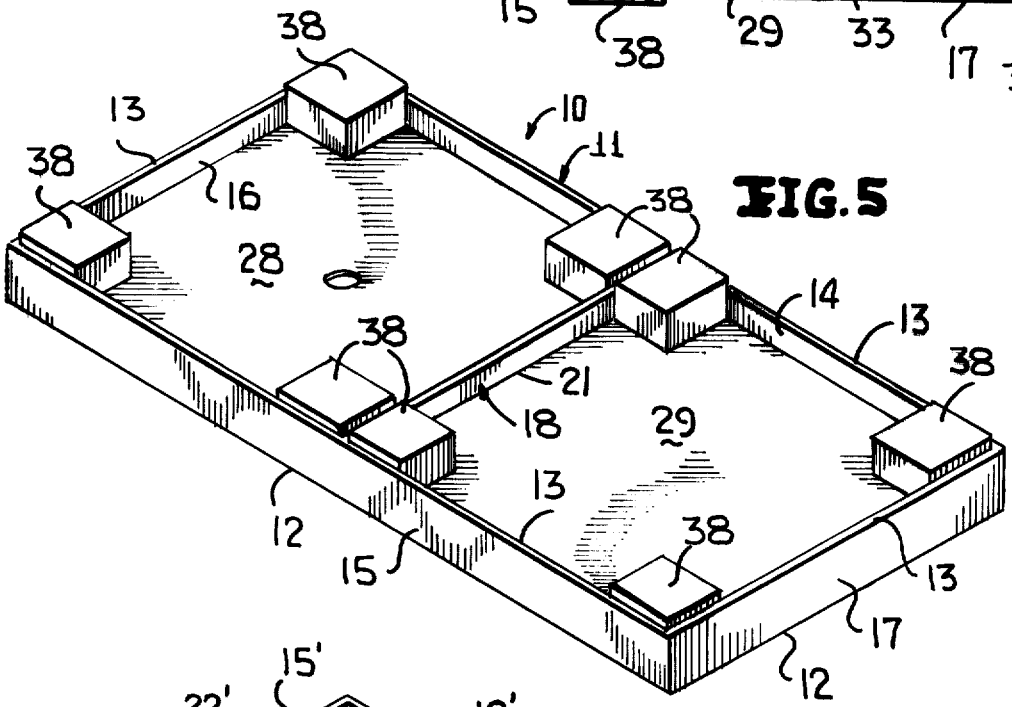
FIG. 5 is a bottom perspective view of the pad, and more clearly illustrates each reinforcing foot and its associated corner.

When the pad 10 is constructed for supporting two or more appliances, it further includes a central or medial wall 18 located approximately midway between the walls 16 and 17. The medial wall 18 likewise includes an uppermost terminal edge or edge portion 20 and a lowermost terminal edge or edge portion 21 (FIG. 5).

Disposed between the upper and lower edge portions 12 and 13 of the polygonal peripheral wall 11 and the upper and lower edge portions 20 and 21, respectively, of the medial wall 18 are a pair of inboard supporting walls or ledges 22, 23 each of a generally annular rectangular configuration defined by an upper wall surface 24, 25, respectively, respective innermost or inboard surfaces 26, 27 which are disposed generally vertically and are substantially normal to the respective surfaces 24, 25, and lowermost surfaces 28, 29 (FIG. 5) which are generally parallel to the respective surfaces 24, 25. The lowermost surfaces 28, 29 define in part respective bottom walls, 30, 31 (FIG. 2) having respective upper surfaces 32, 33. The surfaces 32 of the wall 30 and the inboard polygonal surface 26 of the ledge 22 defines a generally rectangular upwardly opening chamber 34, while the corresponding surface 33 and the inboard surfaces 27 of the ledge 23 define a like upwardly opening generally rectangular chamber 35. The chambers 34, 35 are adapted to collect or catch water spilled or leaked therein from the associated clothes washer CW or clothes dryer CD or like appliances. In the case of the chamber 35, the wall is unapertured since a relatively little amount of water might leak from the clothes dryer CD and while the same will accumulate in the chamber 35, the normal circulation of air will cause evaporation of such water. However, in the case of the chamber 34, the wall 32 thereof is provided with a drain fitting 36 which is connected to an aperture (unnumbered) generally centrally located relative to the wall 32 which includes an outlet O (FIG. 3) coupled or connected in a conventional manner to the drain D. The latter construction is provided relative to the chamber 34 since if a leak does occur relative to the clothes washer CW, such would normally cause an appreciable amount of water to flow therefrom and, thus, a connection to the drain D is desired.

Appliances such as the clothes washer CW and the clothes dryer CD generally have a foot at each of the respective corners (unnumbered) and such feet or legs are normally screw-threaded for adjustment purposes to level these appliances with respect to the supporting surface S, and such feet are shown in FIG. 3 and are generally designated by the reference character F. The feet F localize the forces created by the weight of the clothes washer CW and the clothes dryer CD at each corner (unnumbered) of the pad 10 and unless otherwise provided for, the ledges 22, 23 might be damaged. Thus, in keeping with this invention, an identical generally square reinforcing block or foot is disposed at each corner of the pad 10 at the underside of the associated ledge 22, 23 and is preferably formed as an integral molded element, although these feet, which are generally designated each by the reference character 38, may be separately formed and bonded or otherwise secured at each of the corners in the manner best illustrated in FIG. 5. In this fashion, each of the corners is highly reinforced, and damage from the localized forces created by the feet F is virtually eliminated. Additionally, the feet 38 project slightly beyond the lowermost edge 13 of the peripheral wall 11 and the lowermost edge 21 of the medial wall 18, although the edges latter-identified and the bottoms (unnumbered) of the feet 38 can be perfectly flush or coplanar.

Though the wall 30 of the chamber 34 is illustrated as being perfectly flat or uniplanar, the same may have an upwardly opening concave configuration so that water collected within the chamber 34 will flow under the influence of gravity toward the center into and through the drain 36.

The pad 10 is further constructed as a single, one-piece, unitary molded product of homogenous polymeric material of high-impact resistance, although alternatively the same may be constructed from fiberglass, metal, or combinations of the latter material.

Figure 6:
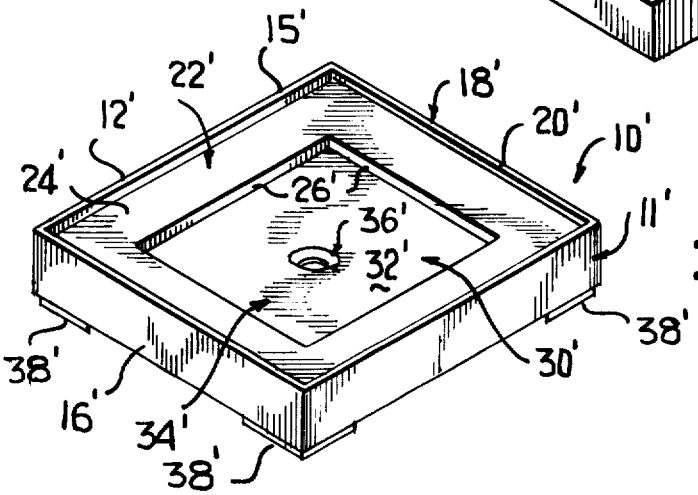
FIG. 6 is a perspective view of another pad constructed in accordance with this invention, which in lieu of supporting two or more appliances is designed to support merely one appliance.

As was heretofore noted, in lieu of utilizing the pad 10 for two or more appliances, reference is made to FIG. 6 which shows a pad 10' constructed for a single appliance, and the structure thereof is identical to the left half of the pad 10 shown in FIG. 2 and, therefore, identical though primed reference numerals have been applied thereto. Thus, the pad 10' is adapted to receive therein, support thereupon, and collect water leaked from a clothes washer, noting the drain or outlet 36'. Obviously, the latter structure may be eliminated and the pad 10' would then correspond to the right hand half of the pad 10 of FIG. 2 and would be adapted to support thereupon a single clothes dryer corresponding to the clothes dryer CD of FIG. 1.

Although only a preferred embodiment of the invention has been specifically illustrated and described herein, it is to be understood that minor variations may be made in the apparatus without departing from the spirit and scope of the invention, as defined in the appended claims.

I claim:

1. A pad for protecting floors against water damage from washers, dryers or like appliances comprising a generally polygonally contoured peripheral wall having an outer surface and generally coplanar spaced upper and lower inner surfaces, said lower inner surface merging generally normally with a lower generally horizontal surface, a pair of upper generally parallel horizontal surfaces vertically offset from each other, a first of said upper horizontal surfaces being wholly inboard of and surrounded by a second of said upper horizontal surfaces, said second upper horizontal surface being of a squared-off annular configuration as viewed from above, said second upper horizontal surface being disposed generally normal to said upper inner surface, a second innermost peripheral surface disposed generally normal to said first and second upper horizontal surfaces and defining the vertical offset therebetween, said second innermost peripheral surface and said first upper horizontal surface defining an upwardly opening polyognal chamber wherein water is adapted to drain and/or accumulate from an associated washer, dryer or like appliance associated with said pad, said second upper horizontal surface and lower horizontal surface outboard of said second innermost peripheral surface defining a reinforced supporting ledge adapted to support thereon inboard of said upper inner surface the legs of an associated washer, dryer or like appliance, said lower inner surface defining four corners beneath said lower horizontal surface, a reinforcing foot at each of said corners beneath said lower horizontal surface, said upper inner surface completely bounding said ledge, and each foot having a bottom face below said lower horizontal surface.

2. The pad as defined in claim 1 including aperture means passing through a wall defined by said first upper horizontal surface and said lower horizontal surface through which water may be drained from said chamber.

3. The pad as defined in claim 1 wherein said pad is constructed from a single piece of molded, integral, homogenous polymeric material.

4. The pad as defined in claim 2 wherein said pad is constructed from a single piece of molded, integral, homogenous polymeric material.

5. A pad for protecting floors against water damage from washers, dryers or like appliances comprising a generally polygonally contoured peripheral wall and a central wall cooperative with said peripheral wall and defining therewith two generally similar pad portions each of which is adapted to support an associated washer, dryer or like appliance, said peripheral wall having an outer surface and generally coplanar spaced upper and lower inner surfaces, said central wall likewise having generally coplanar spaced upper and lower inner surfaces merging generally normal with said peripheral wall upper and lower inner surfaces, respectively, said lower inner surfaces merging generally normal with an associated one of a pair of lower generally horizontal surfaces, a pair of upper generally parallel horizontal surfaces vertically offset from each other at opposite sides of said central wall and above an associated one of said pairs of lower generally horizontal surfaces, a first of each pair of said upper horizontal surfaces being wholly inboard of and surrounded by a second of each pair of said upper horizontal surfaces at opposite sides of said central wall, each said second upper horizontal surface being of a squared-off annular configuration as viewed from above, said second upper horizontal surfaces being disposed generally normal to said peripheral wall and central wall upper inner surfaces, a second innermost peripheral surface disposed generally normal to said first and second upper horizontal surfaces at each side of said central wall and defining with the associated first upper horizontal surfaces first and second upwardly opening polygonal chambers at opposite sides of said central wall wherein water is adapted to drain and/or accumulate from an associated washer, dryer or like appliance associated with each pad portion, each of said second upper horizontal surfaces and associated lower horizontal surfaces of outboard of said second innermost peripheral surfaces defining a reinforced supporting ledge surrounding each of said upwardly opening chambers and being adapted to support thereon inboard of said upper inner surfaces the legs of an associated washer, dryer or like appliance, said lower peripheral wall inner surface defining four corners beneath said lower horizontal surfaces, a reinforcing foot at each of said corners beneath the associated lower horizontal surface, said peripheral wall upper inner surface completely bounding said ledge, and each foot having a bottom face below said horizontal surfaces.

6. The pad as defined in claim 5 including aperture means associated with only one of said chambers for draining water therefrom.

7. The pad as defined in claim 5 wherein said pad is constructed from a single piece of molded, integral, homogeneous polymeric material.

8. The pad as defined in claim 5 including a corner defined by each peripheral wall and central wall lower inner surfaces, and a reinforcing foot at each of said last-mentioned corner.

9. The pad as defined in claim 6 wherein said pad is constructed from a single piece of molded, integral homogeneous polymeric material.

10. The pad as defined in claim 7 including a corner defined by each peripheral wall and central wall lower inner surfaces, and a reinforcing foot at each of said last-mentioned corner.

11. The pad as defined in claim 9 including a corner defined by each peripheral wall and central wall lower inner surfaces, and a reinforcing foot at each of said last-mentioned corner.

* * * * *